US006210503B1

(12) United States Patent
Naylor et al.

(10) Patent No.: US 6,210,503 B1
(45) Date of Patent: Apr. 3, 2001

(54) ROLLER PIN MATERIALS FOR ENHANCED CAM DURABILITY

(75) Inventors: Malcolm G. Naylor; John T. Morgan, both of Columbus; Suzanne P. Raebel, Bloomington; Brian J. Lance, Franklin, all of IN (US); Carl F. Musolff, Ashville; Joe W. Dalton, Jamestown, both of NY (US)

(73) Assignee: Cummins Engine Company, Inc., Columbus, IN (US)

( * ) Notice: Subject to any disclaimer, the term of this patent is extended or adjusted under 35 U.S.C. 154(b) by 0 days.

(21) Appl. No.: 08/970,102

(22) Filed: Nov. 13, 1997

(51) Int. Cl.[7] ..... C22F 1/08

(52) U.S. Cl. ..... 148/680; 148/434; 148/904; 123/90.39; 123/90.44; 123/90.51

(58) Field of Search ..... 148/434, 904, 148/680; 123/90.39, 90.51, 90.44

(56) References Cited

U.S. PATENT DOCUMENTS

| | | | | |
|---|---|---|---|---|
| 2,062,448 | | 12/1936 | Deitz et al. | 420/473 |
| 4,090,197 | | 5/1978 | Cantrell | 342/148 |
| 4,462,957 | | 7/1984 | Fukui et al. | 376/327 |
| 4,708,102 | * | 11/1987 | Schmid | 123/90.35 |
| 4,962,743 | | 10/1990 | Perr et al. | 123/496 |
| 5,011,079 | | 4/1991 | Perr | 239/95 |
| 5,082,433 | | 1/1992 | Leithner | 419/11 |
| 5,246,509 | | 9/1993 | Kato et al. | 148/434 |
| 5,529,641 | | 6/1996 | Saka et al. | 148/323 |
| 5,816,207 | | 10/1998 | Kadokawa et al. | 123/90.42 |

FOREIGN PATENT DOCUMENTS

| | | |
|---|---|---|
| 49-18884 | 5/1974 | (JP) . |
| 8-74526 | 3/1996 | (JP) . |
| 9-195724 | 7/1997 | (JP) . |
| 9324753 | 12/1997 | (JP) . |

OTHER PUBLICATIONS

Alloy Digest, Mueller Alloy 6730, Filing Code: Cu–486, Nov. 1984, 2 pages.
Alloy Digest, Copper Alloy No. C67300, Filing Code: CU–514, Sep. 1986, 2 pages.
Copy of U.K Search Report dated Apr. 19, 1999. for application No. GB9823807.4.

* cited by examiner

*Primary Examiner*—Sikyin Ip
(74) *Attorney, Agent, or Firm*—Nixon Peabody LLP; Charles M. Leedom, Jr.; Tim L. Brackett

(57) ABSTRACT

A low friction, wear-resistant pin for a cam follower roller useful in the injector and valve trains of internal combustion engines, particularly diesel engines, to enhance cam durability and life is provided. The material selected for the pin, which is selected for its wear resistance, its corrosion resistance, its low friction, and its ability to embed hard debris and other oil contaminants without scuffing, has been demonstrated to improve cam life dramatically. A preferred roller pin material that achieves this objective is a copper-based alloy, most preferably a leaded manganese silicon bronze.

7 Claims, 8 Drawing Sheets

ROLLER PIN MATERIALS FOR ENHANCED CAM DURABILITY

TECHNICAL FIELD

The present invention relates generally to materials for camshaft-actuated cam follower components for internal combustion engines and specifically to a roller pin made from a material that enhances the durability and extends the life of the cam contacted by the roller.

BACKGROUND OF THE INVENTION

Heavy duty diesel engines typically employ a camshaft actuated valve or injector train to convert the rotary motion of the camshaft into the synchronized reciprocating motion required to operate the cylinder head valves and fuel injectors so that the valves and injectors open and close at optimum intervals. The fuel injection interval, in particular, must be very carefully timed so that the high pressure required to achieve the maximum possible atomization of the injected fuel is produced. This is usually achieved by mounting an injector cam on the camshaft to rotate in a fixed relationship with the crankshaft. A rolling cam follower assembly, which includes a pin-mounted roller, rides on the cam and translates the rotational movement of the camshaft to an injector train pushrod or pushtube and through the injector train to a fuel injector. The valve trains for the valves operate in a similar manner to provide the reciprocating motion required for the operation of these structures. U.S. Pat. Nos. 4,090,197; 4,962,743 and 5,011,079, owned by the assignee of the present invention, illustrate this type of fuel injector and valve train.

During engine operation the roller element of the drive train rolling cam follower is continuously contacted by a rotating cam mounted on the camshaft. As a result, the roller rotates constantly when the engine is in operation. Most cam follower rollers are rotatably mounted in a cam follower assembly on a pin. The roller is typically made of steel, the cam follower assembly supporting lever is cast iron, and the pin securing the roller to the lever is bronze. The stresses produced on the cam follower assembly elements, particularly those at the interface between the cam follower roller and the pin, can cause, among other things, undesirable wear of the pin and adversely affect the rotational stability of the roller. Optimal camshaft cam and roller interface conditions cannot be maintained unless the roller is allowed to rotate freely. Without this freedom of rotation, such interface conditions as the maintenance of a lubricant film, the load distribution and the rolling contact may suffer significantly. The susceptibility of the roller pin to wear thus ultimately reduces cam life and engine efficiency because a valve or injector train with a worn pin cannot effectively support a roller to drive a valve or injector to operate with the timing accuracy required.

In addition to the timing problems that accompany worn roller pins, engines that utilize rolling cam followers experience reduced service life from damage to other valve or injector train components when the engine is shut off and started frequently. This reduction in service life results from damage to the camshaft cams and roller followers, primarily from material transfer, known as galling or scuffing, between the surfaces of the camshaft cams and the oscillating follower roller. If left unchecked, such galling eventually leads to spalling of the cam and the functional failure of the engine. High demand traction forces between the cam lobe and roller produces cam galling or scuffing. In extreme cases "skidding" of the roller may result, although damage to the cam may occur without skidding. This condition is particularly severe on startup and shutdown of the engine due to several factors, most of which are related to insufficient oil at the roller-pin interface. The low rotation speeds, characterized by an absence of hydrodynamic oil film, create high friction between the roller and the roller support pin. The insufficient oil supply at the pin-roller interface produces, at best, only a thin oil film, and wear of the pin material under this condition eventually leads to a more conformal contact with the roller, which further reduces the oil film thickness. Reducing the wear between the pin and roller during engine startup and shutdown would obviate these problems.

The prior art has proposed increasing the life of camshaft-mounted cams by forming the cams of wear-resistant materials. U.S. Pat. No. 5,082,433 to Leithner, for example, discloses forming cams from a sintered alloy with a hardened matrix of interstitial copper, consisting of 0.5 to 16% by weight molybdenum, 1 to 20% by weight of copper, 0.1 to 1.5% by weight of carbon and, optionally, of admixtures of chromium, manganese, silicon and nickel totalling, at most, 5% by weight, the remainder being iron. Cams and other similar internal combustion engine components, e.g., rocker arms, formed from the foregoing alloy are disclosed to be resistant to sliding wear.

U.S. Pat. No. 5,529,641 to Saka et al. discloses improving the scuffing and pitting resistance of cams on a camshaft by forming the cams of a cast iron comprising 3.0 to 3.6% by weight carbon, 1.6 to 2.4% by weight silicon, 0.2 to 1.5% by weight manganese, 0.5 to 1.5% by weight chromium, 1.5 to 3.0% by weight nickel, 0.5 to 1.0% by weight molybdenum, 0.0003 to 0.1% by weight of at least one chilling promoting element selected from the group consisting of bismuth, tellurium and cerium, and the balance iron and unavoidable impurities. Neither the Saka et al. nor the Leithner patents suggests that the material forming the pin mounting a cam-contacting roller in the engine drive train affects cam wear.

U.S. Pat. No. 5,246,509 to Kato et al. discloses a wear-resistant copper base alloy for forming a floating bush bearing in an engine turbocharger. This alloy comprises 1.0 to 3.5 wt % manganese, 0.3 to 1.5 wt % silicon, 11.5 to 25 wt % zinc, 5 to 18 wt % lead, and the balance substantially copper and incidental impurities. Although this alloy is stated to withstand the operation at high sliding speed and high temperature in a highly-corrosive condition typically encountered in a turbocharger, it is not suggested that this alloy would resist the rolling wear or the conditions encountered by a pin supporting a cam-contacting roller.

U.S. Pat. No. 4,462,957 to Fukui et al. discloses roller and pin structures, wherein both structures are made of wear-resistant alloys. The pin and roller structures described in this patent are used in the guide mechanism of a nuclear reactor control rod. Not only are the rollers fixed so they do not contact a cam-like structure, but there is no suggestion that the material from which the pin is formed affects the life of any structure that does not contact the pin.

Two "Alloy Digest" publications describe copper alloys useful as bearings, bushings and the like. Mueller Alloy 6730 is composed of 60.5% copper, 2.5% manganese, 1.0% lead, 1.0% silicon, and 35.0% zinc. Copper Alloy No. C67300 is composed of 58.0 to 63.0% copper, 2.0 to 3.5% manganese, 0.5 to 1.5% silicon, 0.40 to 3.0% lead, 0.50% max iron, 0.30% max tin, 0.25% max nickel, 0.25% max aluminum, and the remainder zinc. These alloys are stated to be useful for forming bearings, bushings, cams and idler pins. It is not suggested that either of these alloys could be used to form a pin for a cam-contacting roller to enhance the durability of a cam which is not directly contacted by the roller. It is also not suggested that either of these alloys combine high wear and corrosion resistance in the presence of lubricant additives.

In one commonly available cam follower roller and pin assembly the roller is made from steel, and the pin is made from a leaded phosphor bronze. It has been discovered, however, that this pin material is not sufficiently low friction or wear-resistant or corrosion-resistant in the presence of lubricant additives to prevent cam galling or failure.

The prior art, therefore, has failed to provide a pin that is low friction, wear-resistant and corrosion-resistant in the presence of engine oil additives for rotatably mounting a cam follower roller in a drive train of a heavy duty internal combustion engine made of a material which is corrosion-resistant, is capable of embedding hard debris without scuffing, and is capable of carrying the mechanical loads imposed on the cam follower. The prior art has further failed to provide a cam follower roller pin made from a material that prevents cam failure and enhances cam durability.

SUMMARY OF THE INVENTION

It is a primary object of the present invention, therefore, to provide a pin for supporting a cam follower roller for a heavy duty internal combustion engine drive train that overcomes the disadvantages of the prior art and is made of a material that prevents cam failure and enhances cam durability.

It is another object of the present invention to provide a low friction, wear-resistant, corrosion-resistant and scuff-resistant cam follower roller pin.

It is yet a further object of the present invention to provide a pin for a cam follower roller for an internal combustion engine made of a material that is capable of carrying the mechanical loads imposed on the cam follower roller.

It is still another object of the present invention to provide a wear and corrosion-resistant pin for rotatably mounting a cam follower roller to an internal combustion engine cam follower assembly that prevents cam galling.

It is a still further object of the present invention to provide a pin for a cam follower roller that maintains optimal camshaft and roller interface conditions during engine startup and shutdown.

The foregoing objects are achieved by providing a wear-resistant and corrosion-resistant pin for rotatably mounting the cam-contacting roller in an internal combustion engine cam follower. The pin is made from a material having optimally low friction, optimal corrosion resistance, optimal wear resistance, and the ability to embed lubrication oil contaminants without scuffing. The preferred material for forming the pin comprises a leaded manganese silicon bronze, preferably comprising 58.0 to 63.0% by weight copper, 2.0 to 3.5% by weight manganese, 0.5 to 1.5% by weight silicon, 0.4 to 3.0% by weight lead, 0.50 maximum % by weight iron, 0.25 maximum % by weight nickel, 0.30 maximum % by weight tin, 0.25 maximum % by weight aluminum, and the remainder zinc. The foregoing objects are further achieved by providing a method of enhancing the durability of camshaft-mounted cams in an internal combustion engine comprising forming the cam-contacting cam follower roller support pin from a low friction, wear, corrosion and scuff-resistant metal alloy having a composition selected to increase cam longevity.

Other objects and advantages will be apparent from the following description, claims and drawings.

DESCRIPTION OF THE PREFERRED EMBODIMENTS

Figure 1:
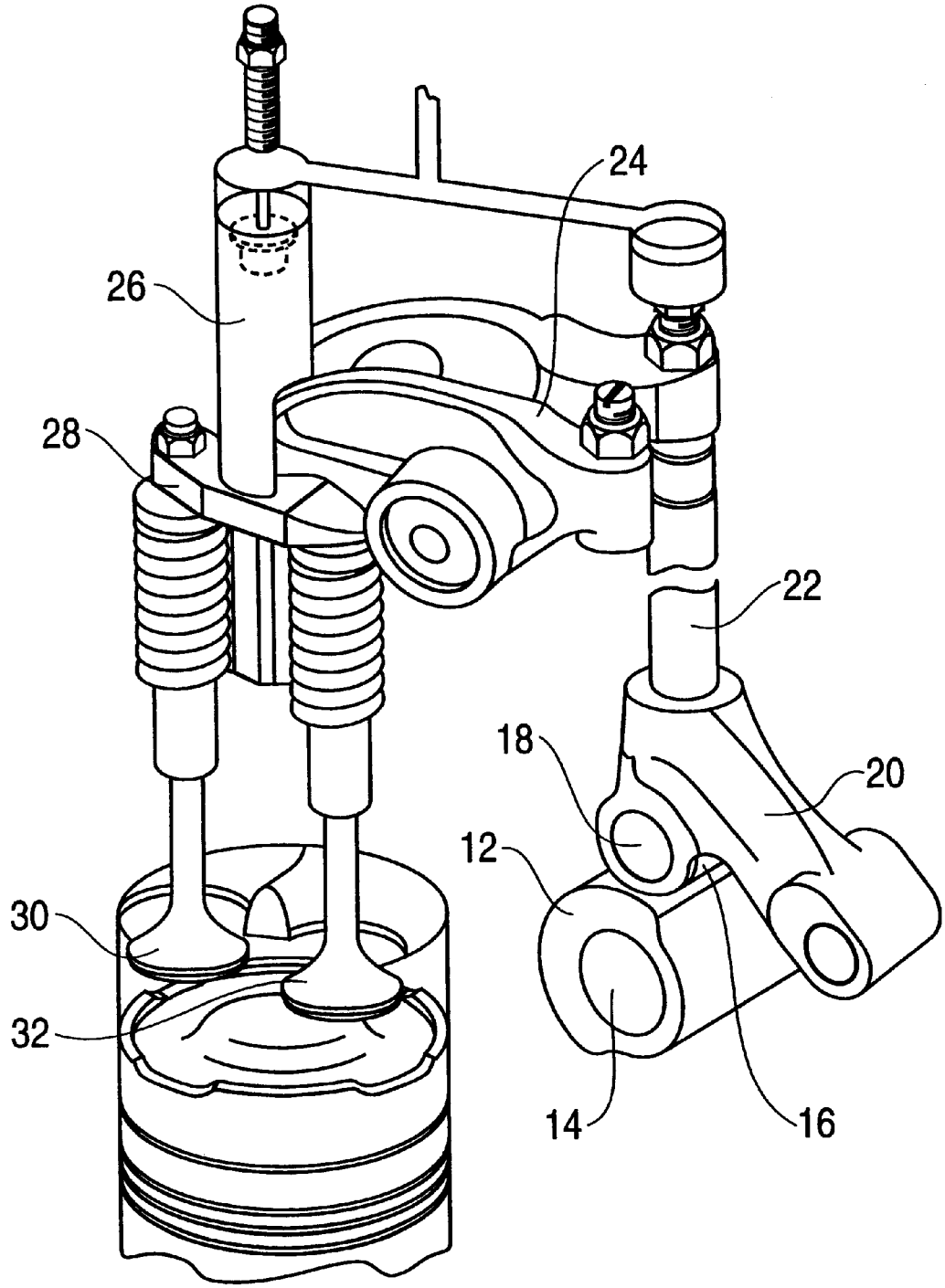
FIG. 1 illustrates schematically a rolling cam follower in the drive train of an internal combustion engine.

Internal combustion engines that employ rolling cam followers or cam-contacting rollers to contact cams on the engine camshaft, thereby transmitting power to the valves and/or fuel injectors in the engine valve or injector train have been shown to experience reduced service life when the engine is started and shut off frequently. Engine service life is usually reduced as a result of damage to the camshaft and roller followers. Such damage is caused primarily by galling or scuffing, which transfers material between the surfaces of the camshaft cam lobe and the oscillating cam-contacting roller. Eventually the galling leads to spalling of the cam and a functional failure.

One ultimate effect of a cam damaged by galling in a fuel injector train could be poor injection timing. This would lead to inefficient combustion and poor engine performance. Other injector train components could become worn unevenly by excessive random movement of the roller and function improperly. In a worst case situation the entire injector train could fail to meet minimum functional requirements and require replacement.

The high demanded traction forces between the cam lobe and the roller, which are particularly severe during engine startup and shutdown, can lead to galling of the cams. The low rotation speeds characteristic of engine startup and shutdown generate only a minimal hydrodynamic oil film, which results in high friction and wear between the pin and roller. In addition, wear of the pin material under these low oil film thickness conditions also increases friction because of the extensive conformal contact between the pin and roller, which reduces the space available for the formation of an oil film between the pin and roller. Reducing such friction between the pin and roller during engine startup and shutdown has been shown to reduce the traction forces between the cam and roller and improve cam durability. It has been discovered, moreover, that the choice of roller pin material unexpectedly significantly increases the life of the cams contacted by pin-supported rollers in an engine valve or injector train. The proper selection of the roller pin material can produce dramatic improvements in cam durability and life.

If the roller is maintained in a stable rotation by the roller pin, optimal cam and roller interface conditions will be maintained. As a result, the lubricant film will be sufficient, the load will be properly distributed, and the rolling contact between the cam and the cam follower roller will insure optimal translation of the camshaft rotation to the drive train. The use of a copper-based alloy, preferably a leaded manganese silicon bronze, has been found to produce an exceptionally wear-resistant roller pin which maintains the roller in a stable rotation. This pin material avoids the adverse effects caused by cam follower rollers supported by pins made from prior art materials. Moreover, a copper-based alloy roller pin and particularly the preferred leaded manganese silicon bronze roller pin of the present invention has high wear resistance, promotes the formation of lubricious oil films at the pin surface, has sufficient corrosion resistance to prevent gross chemical attack of the pin surface by additives or contaminants in the oil, has sufficient ability to embed hard debris or other oil contaminants without scuffing, and has sufficient fatigue resistance to carry the mechanical loads imposed on the cam follower.

Referring to the drawings, FIG. 1 illustrates an exemplary drive train 10 incorporating the cam follower roller pin of the present invention. A cam 12 is mounted on the engine camshaft 14 and rotates as the camshaft rotates. A cam follower roller 16 is rotatably mounted on a roller pin 18 to a cam follower assembly lever 20. The cam follower assembly lever is connected to a push rod 22. The push rod 22 is drivingly connected to a rocker arm 24, which, in turn, reciprocates a fuel injector plunger rod (not shown) in a fuel injector (not shown) or a slave piston 26 which causes a valve crosshead 28 to actuate intake valves or exhaust valves 30 and 32. The roller pin of the present invention is contemplated for use in supporting a cam-contacting roller in any kind of drive train.

Engines that utilize rolling cam followers supported by pins made from commonly available prior art materials used to form roller pins tend to experience reduced service life when the engine is shut off and started frequently. This reduced service life is generally due to damage to the camshaft cams and roller followers. Micrographic examination of failed cam lobes has shown that the damage is caused primarily by material transfer between the surfaces of the cam and the roller resulting from galling or scuffing. The galling or scuffing eventually causes the chipping or fracturing of the cam known as spalling and a functional failure.

Reducing friction between the pin and roller during engine startup and shutdown reduces the traction forces between the cam and roller and results in improved cam durability. The choice of the material forming the roller-supporting pin 18 (FIG. 1) has unexpectedly been found to reduce the undesirable traction forces that lead to cam failure. It has been discovered that the composition of the pin material should be selected to have sufficient wear, corrosion and fatigue-resistance to reduce pin wear and variability with poor oil formulations, and to embed oil contaminants without scuffing. It is thought that the chemical reactivity of the roller pin material with engine oil additives may also have an effect on cam durability; however, the extent of this effect has not been fully established. A copper-based roller pin material has been discovered to meet these requirements and to provide unexpected improvements in cam lobe durability. The extensive rig and engine testing and surface analysis required to select a roller pin material that enhances cam durability and life confirmed that a copper-based material achieves the desired objectives.

One commonly available prior art roller pin material that has been widely used is a leaded phosphor bronze alloy identified by the designation C534. This alloy has the following percent by weight composition:

| | |
|---|---|
| Tin | 3.5–5.8 |
| Phosphorus | 0.03–0.35 |
| Iron | 0.10 maximum |
| Lead | 0.80–1.20 |
| Zinc | 0.30 maximum |
| Copper | 99.5 minimum (includes tin, phosphorus and lead) |

Although this material is a copper-based material and has a suitable bulk hardness to be wear-resistant, it does not enhance cam durability when used to form a roller pin. It has been discovered that when other copper-based materials, in particular a leaded manganese silicon bronze, are used to form roller pins, cam life is significantly enhanced.

It is contemplated that a wide range of copper-based, leaded manganese silicon bronze alloys could be used to form pins to support cam-contacting rollers. The leaded manganese silicon bronze alloy most preferred for forming roller pins in accordance with the present invention, however, is a C67300 alloy having the following percent by weight composition:

| | |
|---|---|
| Copper | 58.0–63.0 |
| Zinc | remainder |
| Manganese | 2.0–3.5 |
| Silicon | 0.50–1.5 |
| Lead | 0.40–3.0 |
| Iron | 0.50 maximum |
| Nickel | 0.25 maximum |
| Tin | 0.30 maximum |
| Aluminum | 0.25 maximum |

It is preferred that the copper-based alloy selected for forming roller pins in accordance with the present invention demonstrate certain minimum mechanical properties as described in the Society of Automotive Engineers specification SAE J463. These properties will depend on the ultimate end use application of the pin since different applications will require pins with different mechanical properties. For example, the minimum Rockwell B Hardness of the most preferred leaded manganese silicon bronze pin material should be about 50 HRB as determined according to ASTM E 18. The most preferred pin material should have at least the following minimum tensile properties as determined according to ASTM E 8:

Tensile Strength, psi—55,000

Yield Strength, psi—25,000

Elongation 4D—10%

In addition, the structure of the most preferred roller pin material is characterized by a matrix that contains a second phase consisting of rod-like manganese silicide particles evenly distributed throughout the matrix. The foregoing mechanical properties characterize the most preferred roller pin material. However, these properties are presented as illustrative of desired properties for a roller pin material that produces demonstrable enhancement of cam durability. Other copper-based alloys with similar or slightly different mechanical properties that effectively prolong cam life when formed into roller pins are also contemplated to fall within the scope of the present invention.

Figure 2:
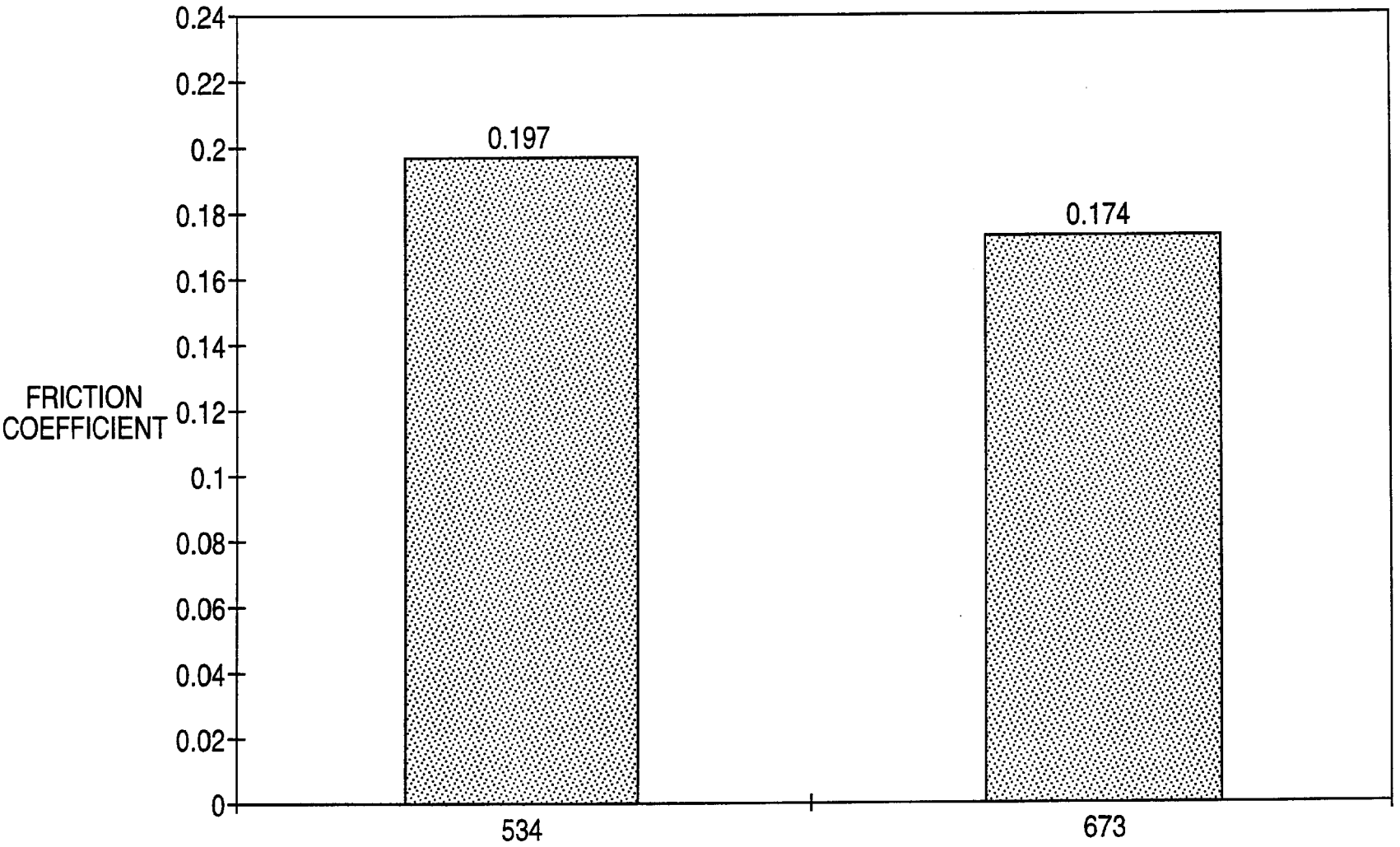
FIG. 2 compares, graphically, the static friction coefficient of a cam follower roller pin made of a prior art material and a roller pin made in accordance with the present invention and a steel cam follower roller.
Figure 3:
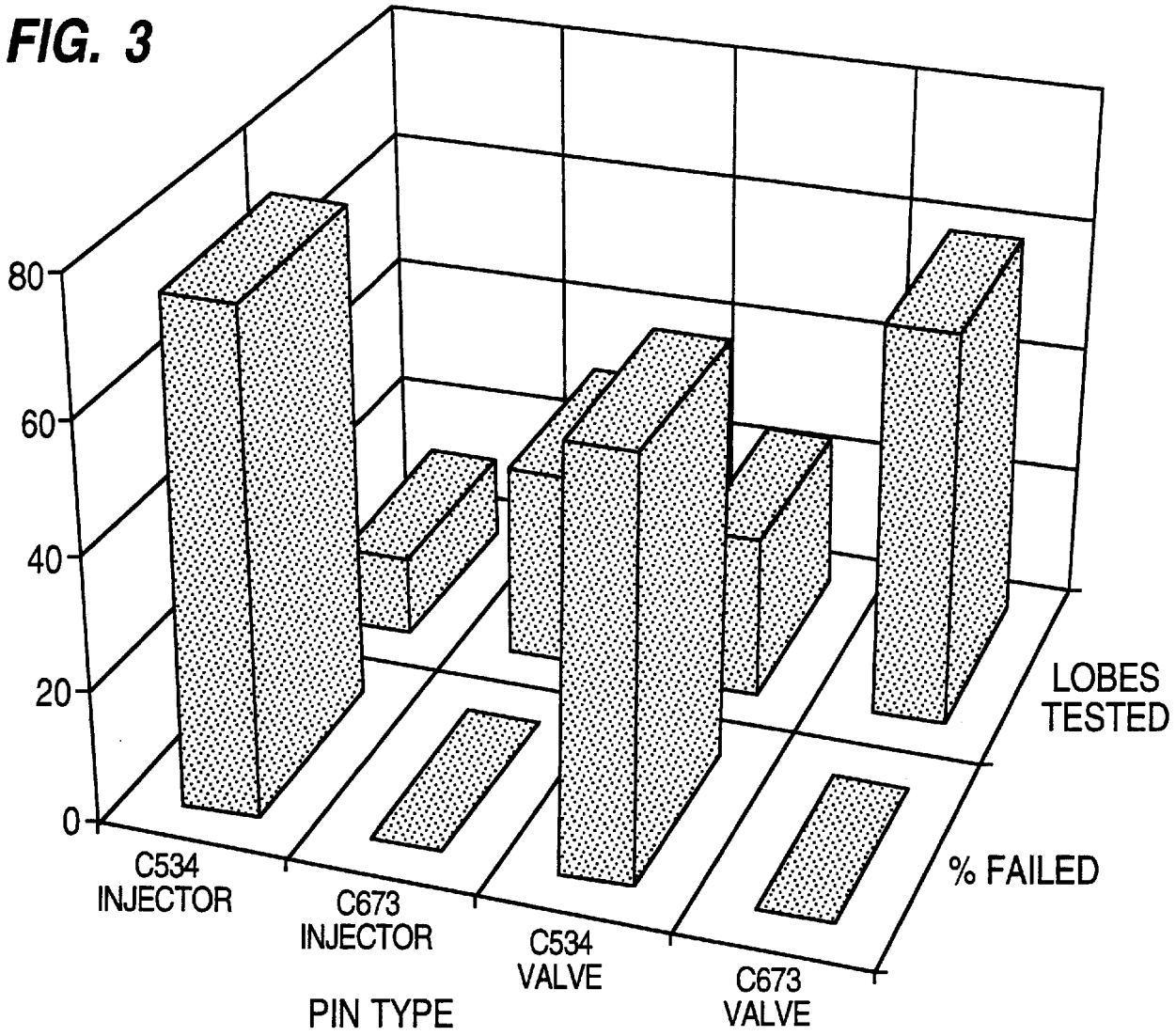
FIG. 3 compares, graphically, the cam lobe damage that occurs with a prior art roller pin material and with a roller pin made in accordance with the present invention.

FIGS. 2 and 3 compare, respectively, friction and cam lobe damage when the pin supporting the cam follower roller is made from the prior art leaded phosphor bronze alloy identified by the designations C534 and 534 with the composition described above and from the preferred copper-based leaded manganese silicon bronze of the present invention. This alloy is referred to herein as "673", "C673" or "C67300". FIG. 2 displays the static friction coefficient for a pin made from the C534 alloy and for a pin made from the C673 alloy. The roller mounted on the pin in both cases was steel. The C534 pin material has a higher friction coefficient than the C673 pin material. FIG. 3 presents a comparison of cam lobe damage with C534 and C673 pin materials. Data is presented for cam lobes in a cam-actuated injector train and in a cam-actuated valve drive train. The percentage of lobes that failed of the number tested is zero for both the injector and valve trains with a C673 leaded manganese silicon bronze roller pin. In distinct contrast, the use of a C534 leaded phosphor bronze roller pin produced cam failure in over 60% of the injector drive trains and in almost 60% of the valve trains in which the cam lobes were tested.

The reduced cam lobe damage is not due to an obvious pin materials characteristic such as higher hardness. The preferred C673 alloy has substantially the same bulk hardness as the prior art C534 alloy. Rather, the improvement in cam life is thought to be due to a combination of factors relating to characteristics of the pin material which act synergistically. These factors include low friction, high wear resistance, corrosion resistance, compatibility with lubricant additives, and debris embeddability.

Figure 4A:
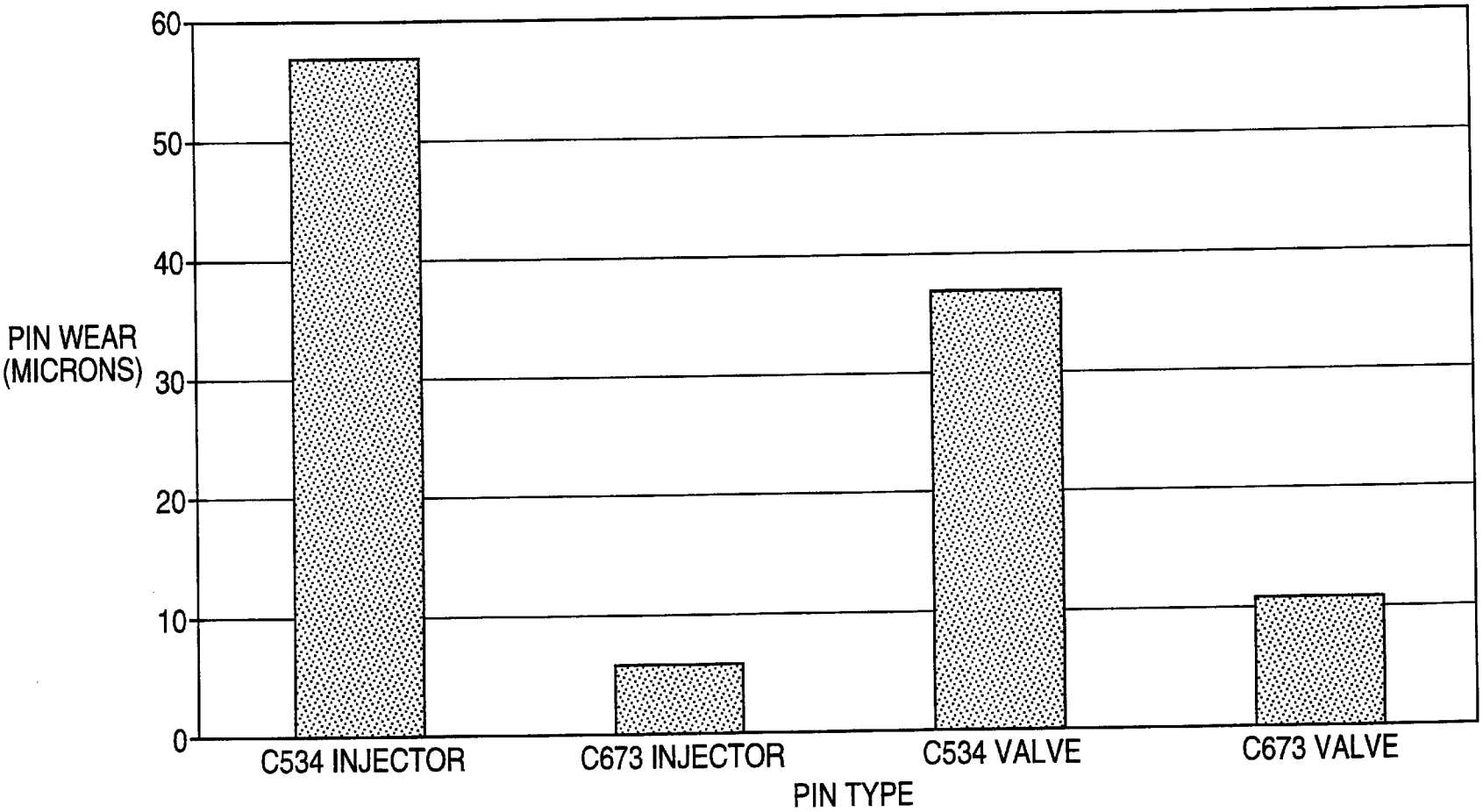
FIG. 4*a* presents a comparison of roller pin wear of a prior art roller pin and a roller pin made in accordance with the present invention.
Figure 4B:
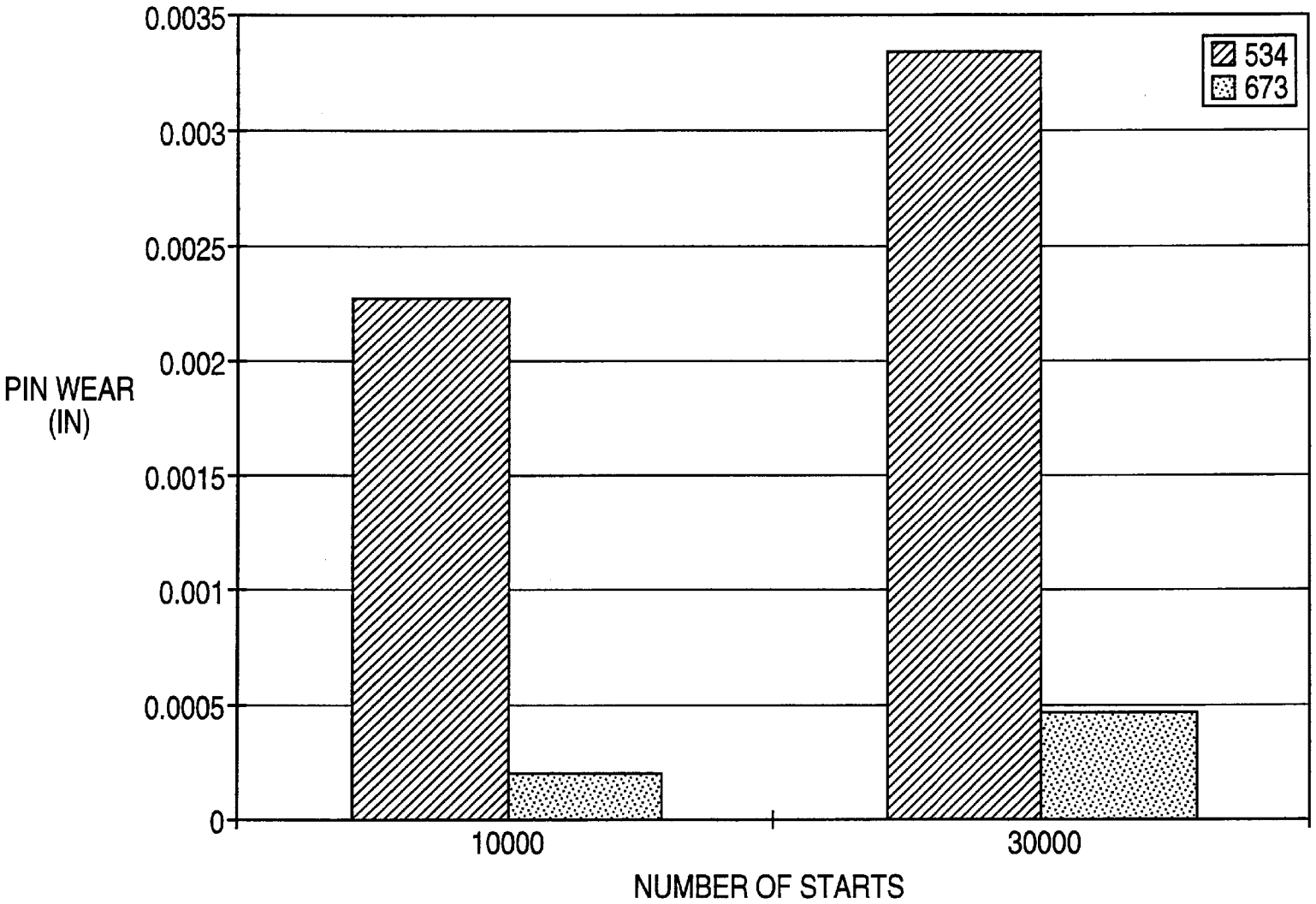
FIG. 4*b* also presents a comparison of roller pin wear of a prior art roller pin and a roller pin made in accordance with the present invention.
Figure 4C:
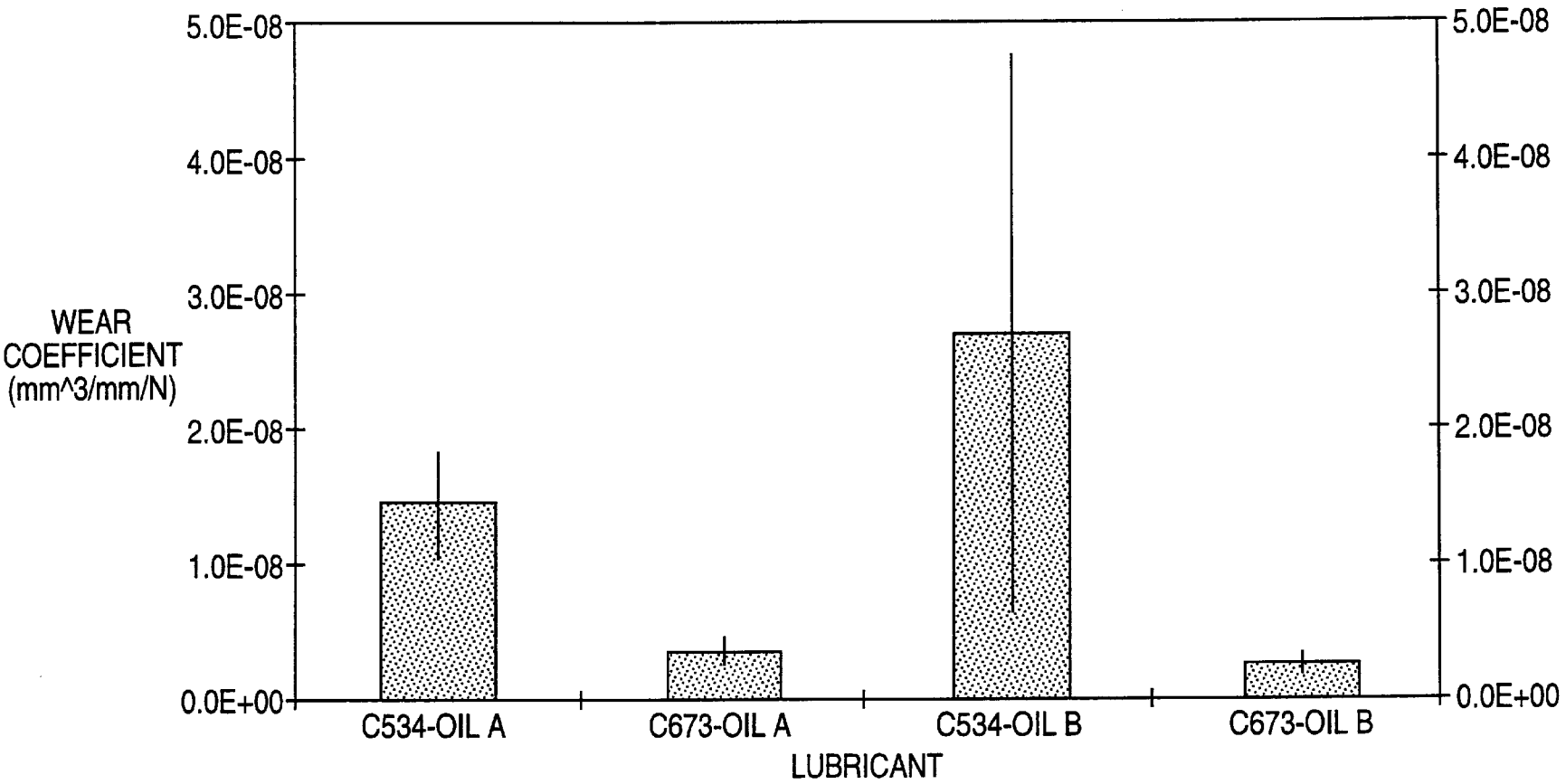
FIG. 4*c* further presents a comparison of roller pin wear of a prior art roller pin and a roller pin made in accordance with the present invention.

The pin material must have high wear resistance. This helps maintain the hydrodynamic properties of the pin by resisting pin wear to a conformal contact with the roller which leads to higher pin-roller friction. FIGS. 4*a*, 4*b* and 4*c* demonstrate that a leaded manganese silicon bronze, such as the preferred C673 alloy, has about 3 to 10 times greater wear resistance than a leaded phosphor bronze, such as the prior art C534, which may be due to the presence of hard manganese silicide precipitates. Other alloys containing hard phases or showing increased bulk hardness would also be expected to show improved wear behavior, but might not necessarily satisfy all of the characteristics required to interact synergistically to enhance cam durability when made into a roller pin.

FIG. 4*a* compares pin wear in microns for C673 and C534 roller pins in injector and valve trains in engine tests. The C673 pins showed substantially less wear than the C534 pins. FIG. 4*b* compares the pin wear in inches for C673 and C534 pins as a function of startups in a roller traction rig test. For both 10,000 and 30,000 engine starts the C673 pins showed virtually negligible wear as compared to the C534 pins. FIG. 4*c* compares the wear for C673 and C534 roller pins in a block-on-ring bench wear test (Falex I wear comparison) using bronze blocks and 52100 steel rings in the presence of good (A) and bad (B) reference oils. The oils used were commercially available lubrication oils. Some of these oils cause more cam galling than others. The oils causing the greatest damage were designated "bad" oils. Even in the presence of the bad reference oil, the wear coefficient for the C673 roller pin was significantly and substantially lower than the wear coefficient for the C534 roller pin. In addition to reducing the average wear, a leaded manganese silicon bronze, such as the preferred C673 alloy, provides a dramatic reduction in the variability of wear, as demonstrated by the tests discussed above. As shown in FIG. 4*c*, the variability in wear can be especially high for traditional pin materials, specifically leaded phosphor bronze, with different commercial oil formulations. The C673 pin, however, was insensitive to oil quality.

Figure 5A:
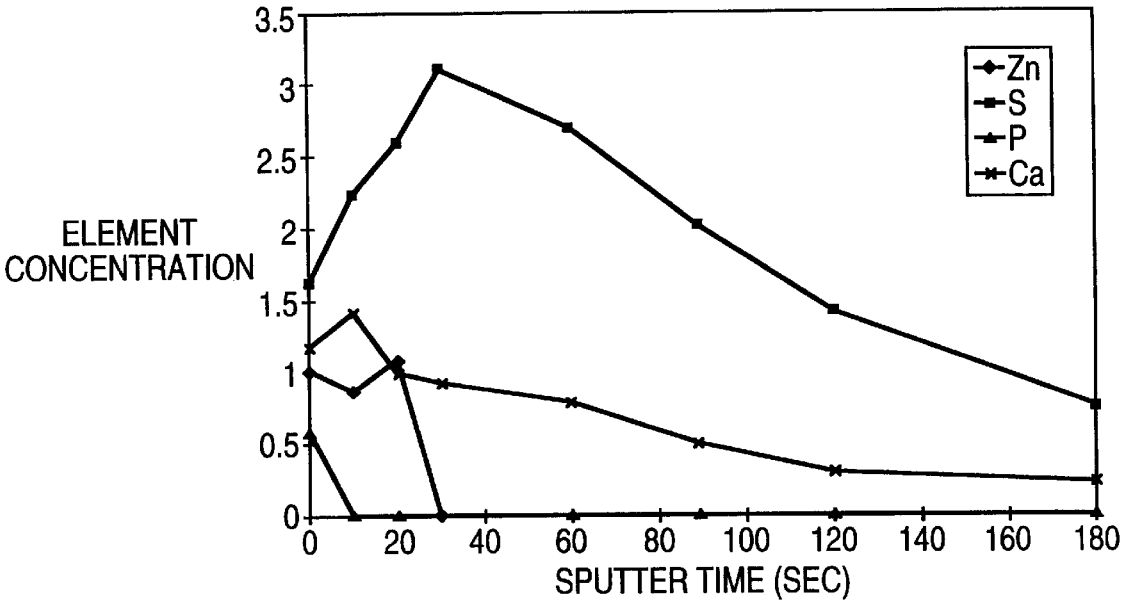
FIG. 5*a* compares the element composition of worn pin surfaces for a roller pin formed from a prior art alloy and a roller pin formed from a copper-based alloy according to the present invention.
Figure 5B:
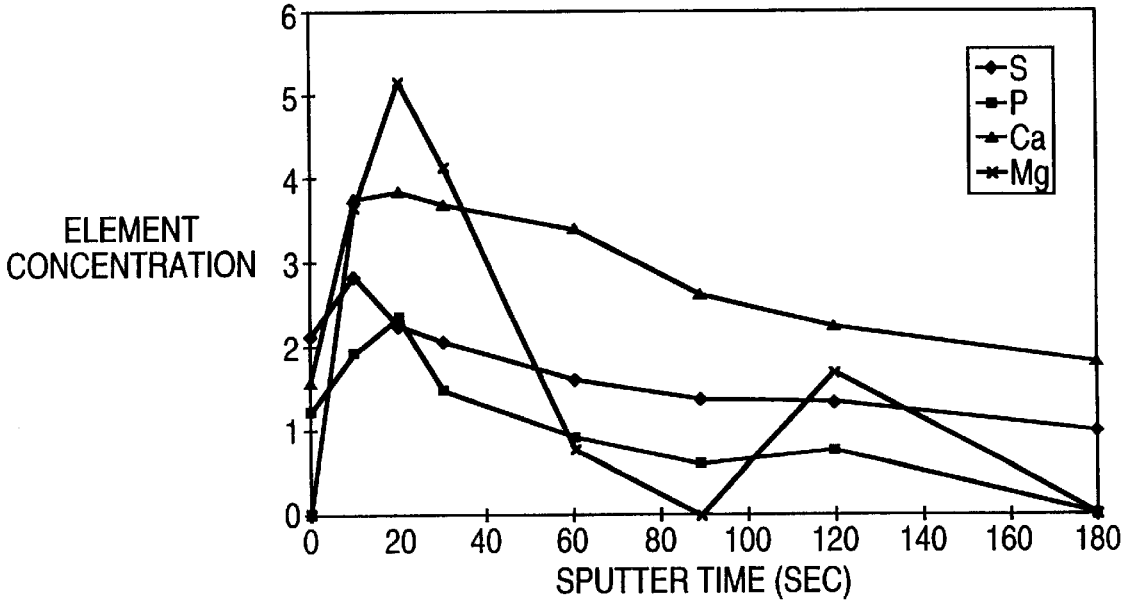
FIG. 5*b* also compares the element composition of worn pin surfaces for a roller pin formed from a prior art alloy and a roller pin formed from a copper-based alloy according to the present invention.

The preferred roller pin material must promote the provision of a lubricious film at the pin surface. Copper-based alloys, particularly leaded manganese silicon bronze alloys, pins have been found to react differently with oil additives than the prior art leaded phosphor bronze pins, notably producing increased levels of magnesium, which is evidence of chemical reaction with oil additives, at the pin surface, as shown in FIGS. 5*a* and 5*b*. The presence or combination of elements such as manganese, silicon and zinc, which are not present in previously available prior art roller pin materials, is thought to be responsible, at least in part, for the differences in lubricant additive reactivity. FIGS. 5*a* and 5*b* illustrate the element composition of surface films from worn surfaces of two engine tested roller pins as analyzed by X-ray photoelectron spectroscopy. FIG. 5*a* shows the element composition for a surface film of a worn prior art leaded phosphor bronze (C534) roller pin, and FIG. 5*b* shows the element composition for a surface film of a worn leaded manganese silicon bronze (C673) roller pin. The element composition of the C673 roller pin demonstrates greater chemical reactivity with oil additives for this pin than for the C534 pin.

Figure 6:
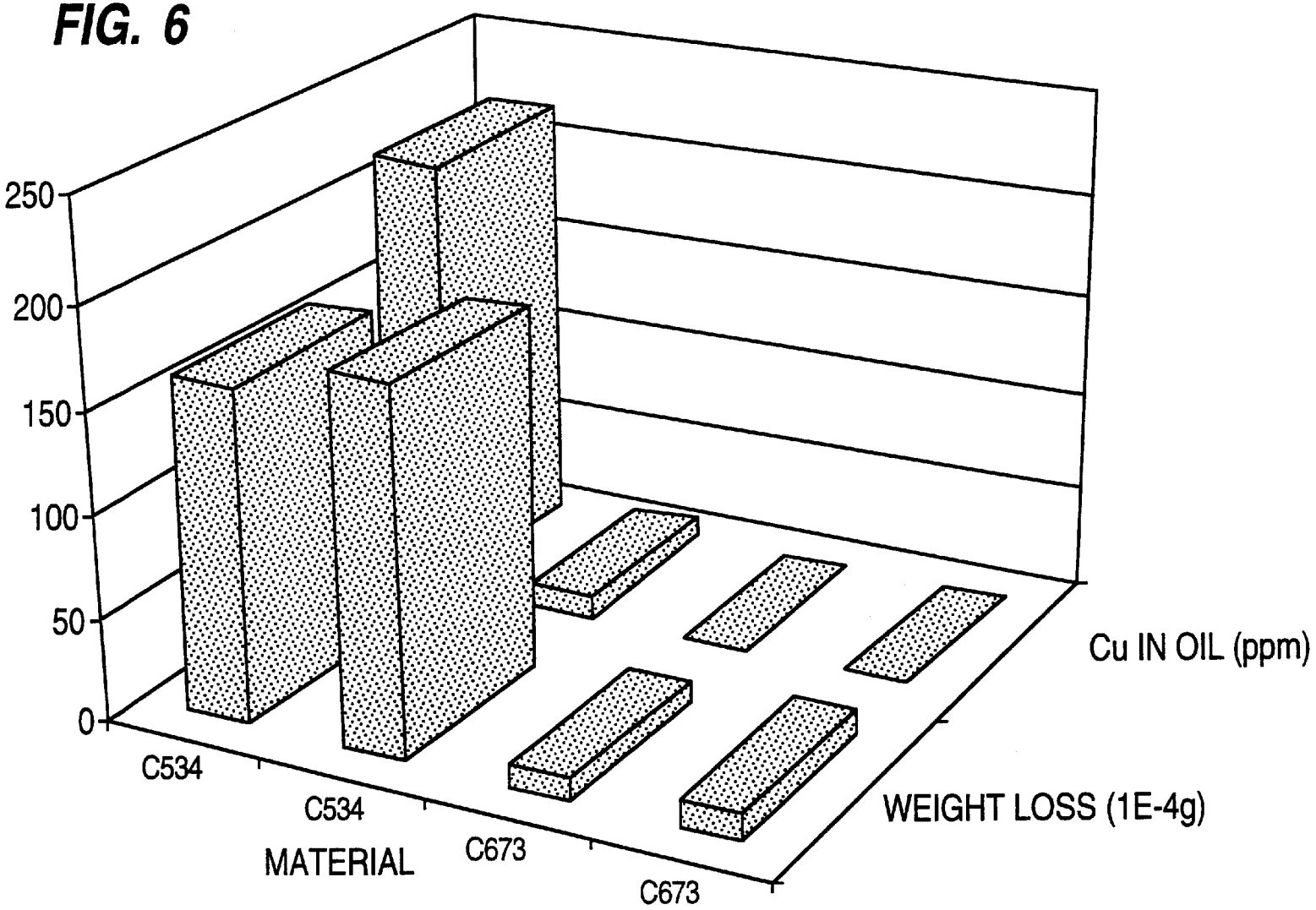
FIG. 6 compares, graphically, the corrosion resistance of a roller pin made from a prior art material and a roller pin made according to the present invention.

FIG. 6 compares the corrosion resistance of a prior art leaded phosphor bronze (C534) roller pin and a leaded manganese silicon bronze (C673) roller pin in a poor quality engine oil after 168 hours at 250° F. To enhance cam life, the roller pin must be made of a material with sufficient corrosion resistance to prevent gross chemical attack of the pin surface by oil additives or contaminants in the oil. Leaded manganese silicon bronze roller pins, as shown in FIG. 6, demonstrated significantly reduced corrosion than the leaded phosphor bronze roller pins when immersed in hot engine oil.

In addition, to enhance cam life, it has been discovered that the material forming the roller pin must have sufficient ability to embed hard debris or other oil contaminants without scuffing. Engine tests have demonstrated that leaded manganese silicon bronze pins are capable of embedding debris without scuffing. Moreover, the pin material must have sufficient fatigue resistance to carry the mechanical loads imposed on the cam follower roller. Rotating beam fatigue tests with a leaded manganese silicon bronze alloy showed a fatigue strength at $10^8$ cycles of 172 MPa. This demonstrates acceptable fatigue resistance for a wide range of anticipated injector and valve roller pin requirements.

The requirements for an optimum roller pin material that will enhance cam durability and life have proved to be complex and often contradictory. The selection of such an optimum roller pin material must be made on the basis of extensive rig and engine testing and surface analysis as described above and not on the basis of simple property data or general knowledge. The copper-based leaded manganese silicon bronze roller pin of the present invention provides unexpected improvements in cam lobe durability. Further, the preferred copper-based leaded manganese silicon bronze roller pin of the present invention displays reduced wear and reduced variability with poor oil formulations while producing improved cam durability. Finally, the present invention clearly demonstrates that the composition of the pin material unexpectedly and significantly extends cam life.

Industrial Applicability

The cam follower roller pin of the present invention will find its primary application in diesel engine valve or injector trains. However, it will also be useful in supporting cam follower rollers in fuel pumps and in any type of apparatus in which a pin-mounted roller contacts rotating cams on a camshaft, and it is desired to enhance cam durability and cam life.

We claim:

1. A method of enhancing the durability of camshaft-mounted cams in an internal combustion engine comprising the step of providing a pin mounting a cam-contacting cam follower roller from a wear and corrosion resistant, low friction copper-based alloy;

wherein said copper-based alloy is a leaded manganese silicon bronze alloy comprising 58.0–63.0% by weight copper 2.0–3.5% by weight manganese 0.5–1.5% by weight silicon, 0.40–3.0% by weight lead, 0.50% by weight maximum iron, 0.25% by weight maximum nickel, 0.30% by weight maximum tin and 0.25% by weight maximum aluminum, and the remainder zinc.

2. A method of enhancing the durability of a cam lobe surface on a rotatable camshaft for an internal combustion engine and minimizing galling effects on said cam lobe surface comprising the steps of:

providing a cam follower roller which contacts and follows said cam lobe surface, said cam follower roller being subject to cyclical mechanical loading by said cam lobe surface as said camshaft rotates; and providing a roller pin for mounting said cam follower roller, said roller pin being maintained at a spaced distance from said cam lobe surface such that said roller pin is free from contacting said cam lobe surface;

wherein said roller pin is made from leaded manganese silicon bronze alloy characterized by low friction, high wear resistance, scuff resistance, sufficient corrosion resistance to prevent gross chemical attack of the pin surface by oil contaminants, sufficient ability to embed hard debris and oil contaminants without scuffing, and sufficient fatigue resistance to carry the cyclical mechanical loads imposed on the cam roller;

wherein said leaded manganese silicon bronze alloy of said roller pin comprises 58.0–63.0% by weight copper, 2.0–3.5% by weight manganese, 0.5–1.5% by weight silicon, 0.40–3.0% by weight lead 0.50% by weight maximum iron, 0.25% by weight maximum nickel 0.25% by weight maximum tin and 0.30% by weight maximum aluminum, with the remainder zinc.

3. The method as described in claim 2, wherein said copper-based alloy of said roller pin includes a matrix with a second phase of rod-shaped manganese silicide particles evenly distributed throughout the matrix.

4. The method as described in claim 2, wherein said copper-based alloy of said roller pin has a minimum Rockwell B hardness of at least 50 HRB.

5. The method as described in claim 4, wherein said copper-based alloy of said roller pin includes a matrix with a second phase of rod-shaped manganese slicide particles evenly distributed throughout the matrix.

6. The method as described in claim 2, wherein said copper-based alloy of said roller pin has a minimum tensile strength of 55,000 psi, a minimum yield strength of 25,000 psi, and a minimum 4D elongation of 10%.

7. The method as described in claim 6, wherein said copper-based alloy of said roller pin includes a matrix with a second phase of rod-shaped manganese silicide particles evenly distributed throughout the matrix.

* * * * *